US005917450A

United States Patent [19]

Tsunekawa et al.

[11] Patent Number: 5,917,450

[45] Date of Patent: Jun. 29, 1999

[54] ANTENNA DEVICE HAVING TWO RESONANCE FREQUENCIES

[75] Inventors: Koichi Tsunekawa; Seiji Hagiwara, both of Yokosuka, Japan

[73] Assignee: NTT Mobile Communications Network Inc., Tokyo, Japan

[21] Appl. No.: 08/754,972

[22] Filed: Nov. 22, 1996

[30] Foreign Application Priority Data

Nov. 29, 1995 [JP] Japan ..... 7-310754

[51] Int. Cl.[6] ..... H01Q 1/38

[52] U.S. Cl. ..... 343/700 MS

[58] Field of Search ..... 343/700 MS; H01Q 1/38

[56] References Cited

U.S. PATENT DOCUMENTS

| | | | |
|---|---|---|---|
| 4,162,499 | 7/1979 | Jones et al. | 343/700 MS |
| 4,644,361 | 2/1987 | Yokoyama | 343/700 MS |
| 4,827,266 | 5/1989 | Sato et al. | 343/700 MS |
| 5,124,733 | 6/1992 | Misao | 343/700 MS |
| 5,642,120 | 6/1997 | Fujisawa | 343/700 MS |

FOREIGN PATENT DOCUMENTS

| | | |
|---|---|---|
| 0226390A2 | 12/1986 | European Pat. Off. . |
| 0637094A1 | 7/1994 | European Pat. Off. . |
| 02124695 | 5/1990 | Japan . |

*Primary Examiner*—Michael C. Wimer

*Attorney, Agent, or Firm*—Pollock, Vande Sande & Amernick

[57] ABSTRACT

An antenna device having two resonance frequencies wherein two radiating patches are respectively provided on one surface and on the other surface of a dielectric plate which is disposed above a ground plate with a space interposed therebetween. A coupling control capacitor element is connected between these two radiating patches and resonance control capacitor elements are connected between the radiating patches and the ground plate, respectively. Capacitance of the coupling control capacitor element is selected such that a current coupled from one of the two radiating patches to the other and a current supplied from the said one of the radiating patches to the other via the coupling control capacitor element are in opposite phase at the other one of the radiating patches.

18 Claims, 8 Drawing Sheets

ANTENNA DEVICE HAVING TWO RESONANCE FREQUENCIES

BACKGROUND OF THE INVENTION

The present invention relates to a compact size antenna device used in, for example, a communication system having a wide bandwidth or a communication system for commonly using two or more communication systems. Particularly, the present invention relates to an antenna device having two resonance frequencies.

FIG. 1 and 2 are diagrams showing prior art antennas. FIG. 1 shows a printed antenna having two radiating patches disposed in opposing relation to each other. FIG. 2 shows a printed antenna having two radiating patches disposed laterally to each other in a common plane. Here, reference numerals 101A, 101B denote radiating patches composed of two conductor plates having different lengths or widths from one another. A reference numeral 102 denotes a feeder line, 103 is a short-circuit metal plate extending between the radiating patches 101A, 101B and a ground plate 104, and 120 is a dielectric plate. In this way, a prior art antenna device attempts to provide two resonance frequencies or a wide bandwidth on a single antenna by resonating the two different sized radiating patches at two different frequencies.

In this case, if a ratio of the two resonance frequencies $F_L$ and $F_H$ is larger than approximately 1.5 (i.e., $1.5\ F_L<F_H$), it is relatively easy to materialize such an antenna device. However, it is difficult to resonate the antenna at two close frequencies having a ratio therebetween less than approximately 1.5 ($F_L<F_H<1.5F_L$), or to attempt a wide bandwidth by using two close frequencies. This is because, since the two resonance wavelengths are close to each other and the two radiating patches are disposed very closely, electromagnetic coupling between the two radiating patches becomes large and the two radiating patches can be regarded as an electrically single body, thus diminishing the effect of using two radiating patches. This problem is significant in the case in which two radiating patches are disposed on upper and lower sides of the dielectric plate 120 as shown in FIG. 1. However, this phenomenon is also significant in the antenna shown in FIG. 2.

Further, since the space between two radiating patches must be large to suppress this problem, there is a shortcoming that the size of antenna becomes large. On the other hand, if, in a state where electromagnetic coupling between the radiating patches is large, the antenna is forced to resonate at two close frequencies by using a matching circuit etc., there would also be a shortcoming that a loss in the matching circuit increases, and thus antenna gain is reduced.

Therefore, in a conventional antenna, there are the following shortcomings: (a) When two radiating patches are disposed very closely, the electromagnetic coupling between them is very large and thus the antenna cannot be resonated at any two desired frequencies; (b) When the antenna is resonated at two very close frequencies, or when a wide bandwidth is attempted by making those two frequencies much closer, the size of antenna becomes large since the space between the radiating patches must be large in order to reduce electromagnetic coupling between the radiating patches; (c) When the space between the radiating patches is made small and the antenna is forced to resonate at two close frequencies by a matching circuit etc., the antenna gain is reduced.

SUMMARY OF THE INVENTION

It is an object of the present invention to provide an antenna device which can resolve the above shortcomings of a conventional antenna and can resonate at desired two frequencies, and wherein a space between radiating patches can be made small even if the antenna device resonates at two very close frequencies so that the size of the antenna is compact, and antenna gain is not reduced.

The antenna device according to the present invention comprises:

a ground plate;

a dielectric plate disposed in parallel with the ground plate;

at least two radiating patches disposed with a space therebetween in parallel with the ground plate on the dielectric plate, one end of each of the radiating patches being electrically grounded to the ground plate;

a feeder line having a inner conductor and an outer conductor substantially connected to at least one of the two radiating patches and the ground plate respectively; and a coupling control capacitor element connected between the radiating patches;

the capacitance of the coupling control capacitor element being so selected that a current electromagnetically coupled from one of the two radiating patches to the other and a current supplied from said one of the two radiating patches to the other via the coupling control capacitor element are in opposite phase to each other at said other one of the radiating patches.

In this way, since the two radiating patches are connected by the coupling control capacitor element, the two radiating patches can be disposed closely adjacent one another and, in addition, two close resonance frequencies can be selected.

DETAIL DESCRIPTION OF THE PREFERRED EMBODIMENTS

Embodiment 1

Figure 1:
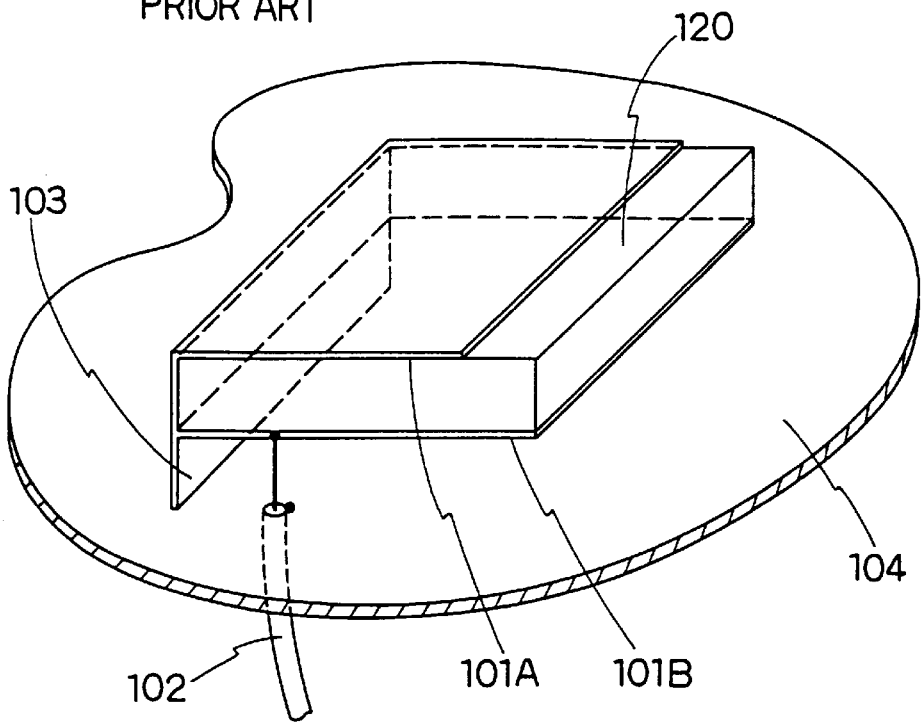
FIG. 1 PRIOR ART
FIG. 1 is a perspective view diagram of a prior art antenna device.
Figure 2:
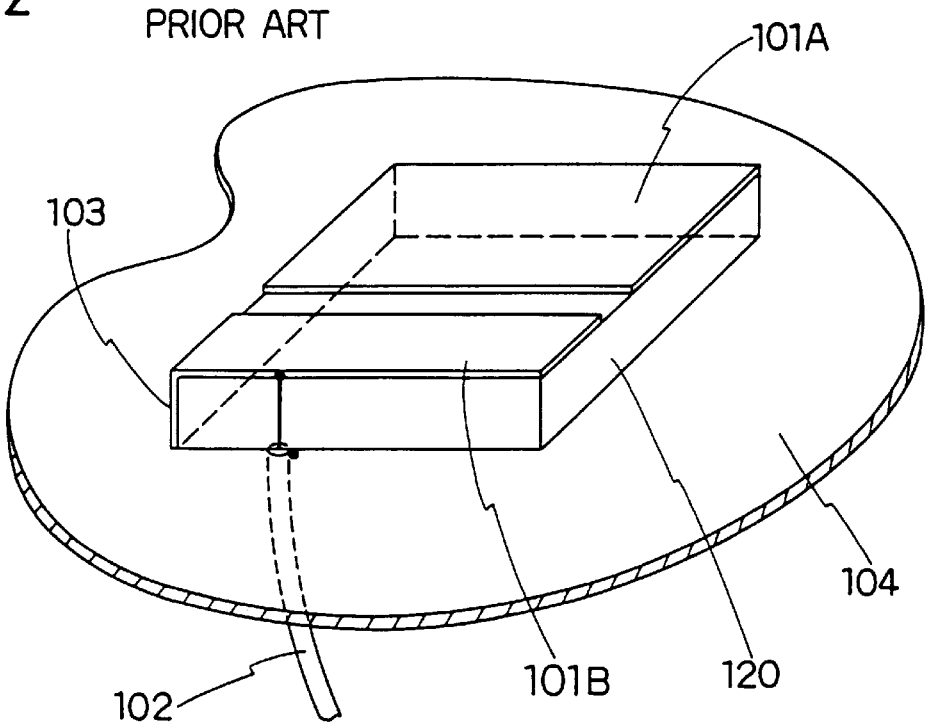
FIG. 2 PRIOR ART
FIG. 2 is a perspective view diagram showing another example of a prior art antenna.
Figure 3:
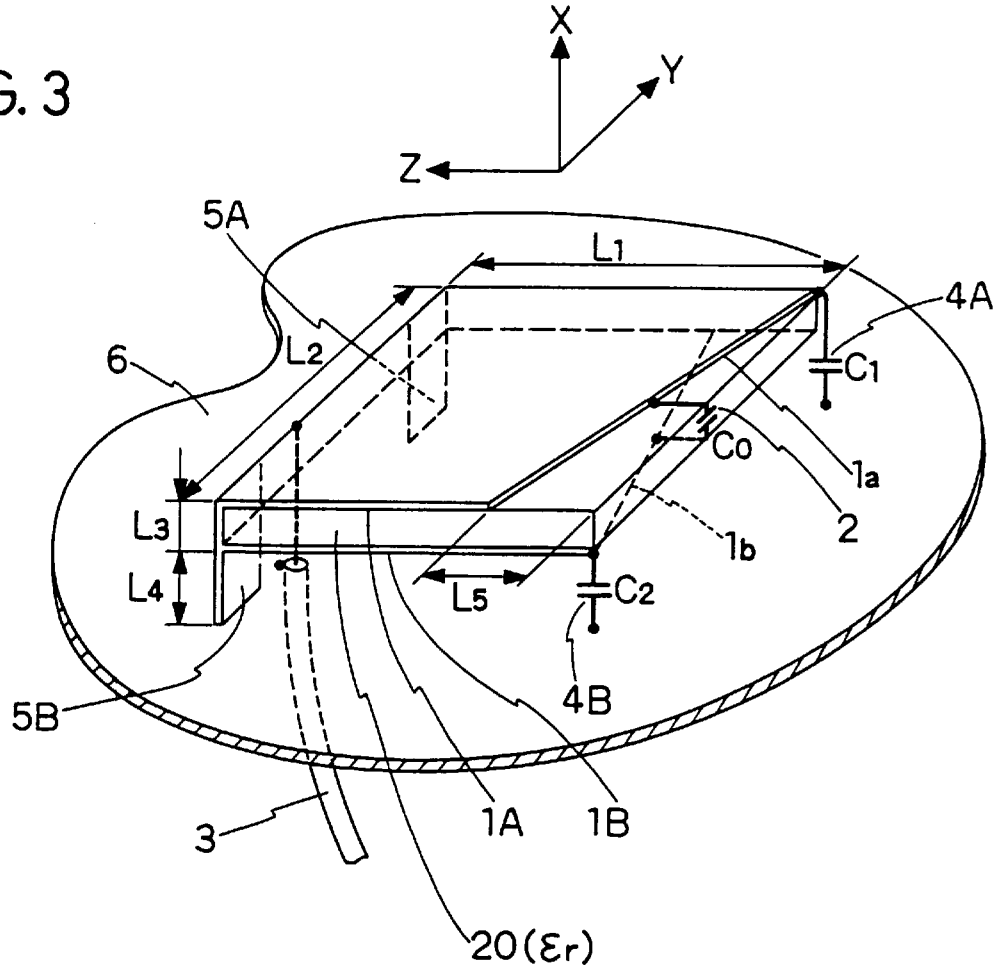
FIG. 3 is a perspective view diagram showing a first embodiment of the present invention together with a metal enclosure.

FIG. 3 shows a first embodiment of the present invention. Two quadrangular radiating patches 1A and 1B, which are disposed to interpose a quadrangular dielectric plate 20 therebetween and face each other, are connected to a ground plate 6 at two points, in this case at both ends of one side of each of the two radiating patches 1A and 1B by grounding metal plates 5A and 5B respectively. One point, in this example one of the mutually opposite end points, on each of the sides (referred to as open ended sides, hereinafter) 1*a* and 1*b* opposite the grounded sides is connected to the ground plate 6 via a corresponding one of resonance control capacitor elements 4A and 4B. In this embodiment, the open ended sides 1*a* and 1*b* to which the capacitor elements 4A, 4B are connected are not in parallel with each other but are oblique in opposite directions. A coupling control capacitor element 2 is coupled between these oblique sides according to the principle of the present invention. The capacitance $C_0$ of the coupling control capacitor element 2 is adjusted so that the current electromagnetically coupled from one of the two radiating patches 1A and 1B to the other and the current supplied from the same one of the two radiating patches to the other via the coupling control capacitor element 2 are in opposite phase to each other at the other one of the radiating patches.

A reference numeral 3 denotes a coaxial feeder line, 5A and 5B denote grounding metal plates, and 6 denotes a ground plate. The purpose for forming the open ended sides 1*a* and 1*b* of the radiating patches 1A and 1B obliquely in opposite directions is to make the resonance frequency bandwidth of each radiating patch wider by varying the length in the Z axis direction along which standing waves are formed. Also, the purpose for forming the sides 1*a* and in non-parallel is to provide a non-overlapped portion between the opposed radiating patches, thereby increasing the feasibility of adjusting the resonance point by each of the capacitor elements 4A and 4B. The inner conductor of the coaxial feeder line 3 is connected to one side of one of the radiating patches, 1A in this example, at a point between the two grounding metal plates 5A and 5B, and the outer conductor of the feeder line 3 is connected to the ground plate 6. The position of the connection point for the inner conductor is determined by a measurement so that the impedance of the antenna device viewed from the connection point may substantially match the characteristic impedance of the feeder line 3, for example 50 ohms.

In this way, coupling between the radiating patches can be controlled by disposing the radiating patches 1A and 1B facing each other in close proximity and substantially in parallel with the ground plate 6. However, the capacitance $C_0$ of the coupling control capacitor element 2 and the capacitances $C_1$, $C_2$ of the resonance control capacitor elements 4A and 4B must be adjusted in accordance with the shapes of the radiating patches and the desired resonance frequencies. The respective heights $L_3+L_4$ and $L_4$ of the radiating patches 1A and 1B from the ground plate 6 together with the mean length $(L_1-L_5/2)$ of the radiating patches in the Z axis direction are factors for determining the resonance frequency of each radiating patch. The distance $L_3$ between the two radiating patches 1A and 1B is a factor for determining the difference between the resonance frequencies. Each radiating patch can be resonated at a desired frequency by adjusting these lengths $L_1$, $L_3$, $L_4$ and $L_5$, and capacitances $C_1$ and $C_2$. In addition, the shortcoming that the size of antenna becomes large can also be obviated since the space $L_3$ between the two radiating patches can be made relatively small even if the antenna is resonated at two very close frequencies.

Figure 4:
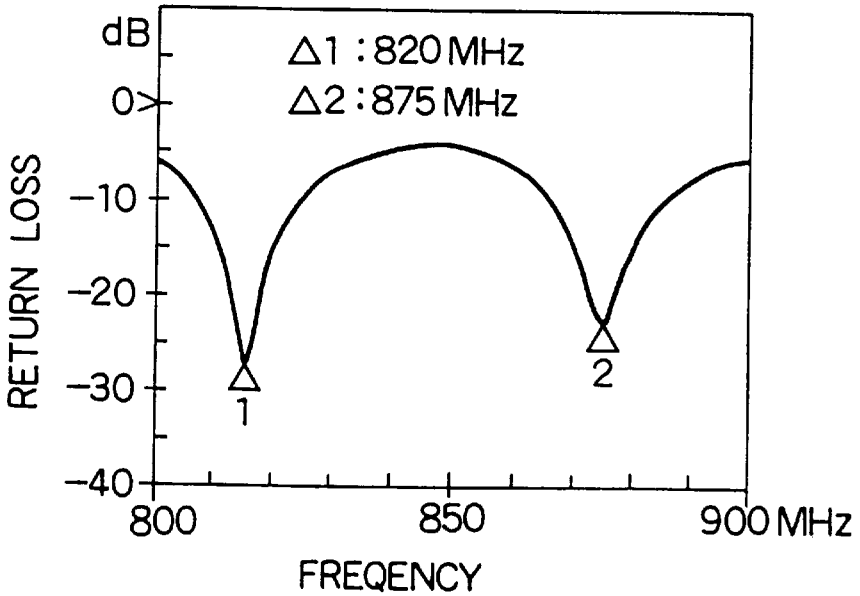
FIG. 4 is a diagram showing a return loss frequency characteristic of the antenna device of FIG. 3.

In order to prove this, a measurement result on an antenna device having the structure of FIG. 3 is shown in FIG. 4. In this case, the dimensions of the portions of the antenna device shown in FIG. 4 were $L_1=L_2=30$ mm, $L_3=1.6$ mm, $L_4=5$ mm and $L_5=10$ mm, the capacitances were $C_0=1.5$ pF, $C_1=0.5$ pF and $C_2=1$ pF, and the relative permittivity $\epsilon_r$ was $\epsilon_r=3.6$. The measurement was carried out by mounting the antenna device on a surface of a rectangular metal case (not shown) having the dimensions of 130×40×20 mm and acting as the ground plate 6. The measured return loss frequency characteristic is shown in FIG. 4. FIG. 4 exhibits a two resonance characteristic and shows that the antenna device resonated at approximately 820 MHz and 875 MHz. In this case, the difference between the resonance frequencies was only about 6%. Even with such a simple structure and such a small spacing $L_3$ between the two radiating patches 1A and 1B as only 1.6 mm, the antenna device resonated at two very close frequencies. This has not been possible in a prior art antenna device. Furthermore, as apparent from FIG. 4, very high antenna gain can be attained at both frequencies. Also, the efficiency of the antenna device of the present invention was measured and high values such as −2.4 dB at 820 MHz and −1.8 dB at 875 MHz were obtained. Thus, it has been proven by an experiment that the antenna device of the present invention can resonate at two close frequencies and can be of small size and high gain.

In this case, even if the shape and size etc. of the two radiating patches are selected different from the parameters given above, a similar effect can be obtained by appropriately selecting the heights $L_3+L_4$ and $L_4$ of the respective radiating patches 1A and 1B from the ground plate 6 and the capacitances of the resonance control capacitor elements 4A and 4B. Moreover, the capacitor elements 2, 4A and 4B can be constituted by such distributed elements as are formed by printed conductors rather than by discrete elements.

Embodiment 2

Figure 5:
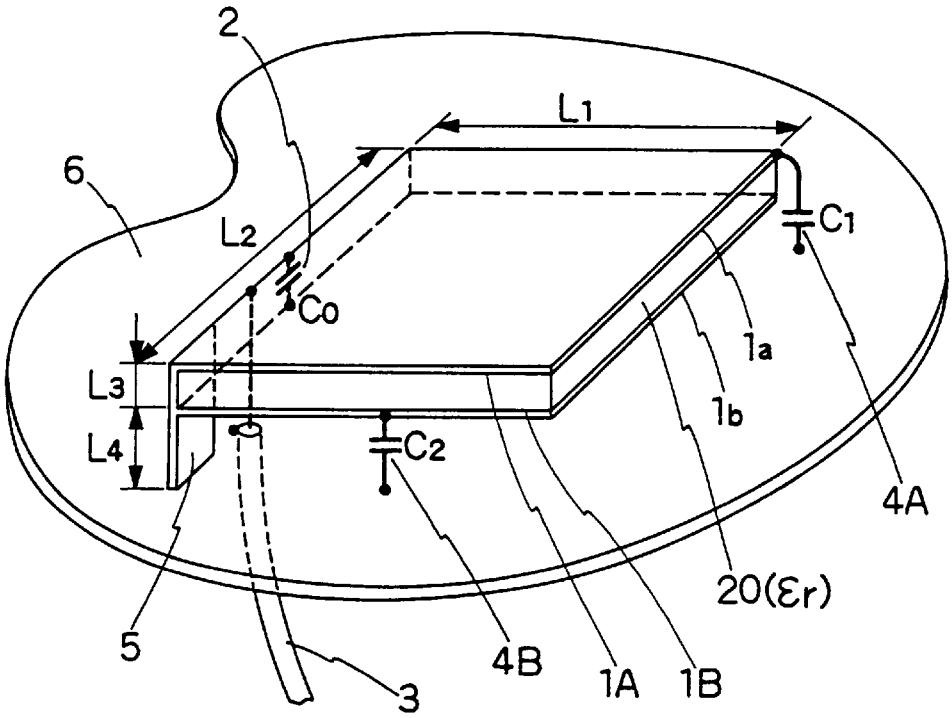
FIG. 5 is a perspective view diagram showing a second embodiment of the present invention.

FIG. 5 shows a second embodiment of the present invention wherein a single grounding metal plate 5 is used. The two radiating patches 1A and 1B are the same right-angled quadrangles having the same dimensions and are disposed facing to one another and interpose therebetween the dielectric plate 20 having the same shape. In this example, both ends of the coupling control capacitor element 2 are connected to the sides of the radiating patches 1A and 1B, respectively, to which the grounding metal plate 5 is connected. In addition, the resonance control capacitor element 4B for one radiating patch 1B is connected to a midpoint of a side adjacent to the side to which the grounding metal plate 5 is connected. The resonance frequencies of the two radiating patches 1A and 1B are adjusted to predetermined values by the capacitances $C_1$ and $C_2$ of the resonance control capacitor elements 4A and 4B, respectively. In this example, $C_1=0.5$ pF and $C_2=1$ pF. The capacitance $C_0$ of the coupling control capacitor element 2 is $C_0=0.5$ pF. The dimensions of the portions shown in the figure are $L_1=L_2=30$ mm, $L_3=1.6$ mm, $L_4=5$ mm, and the relative permittivity of the dielectric plate 20 is $\epsilon_r=2.6$. The connecting positions of the capacitors and the dimensions of the portions were determined through an experimental analysis. In this way, a small size and wide band antenna device can be materialized.

Figure 6:
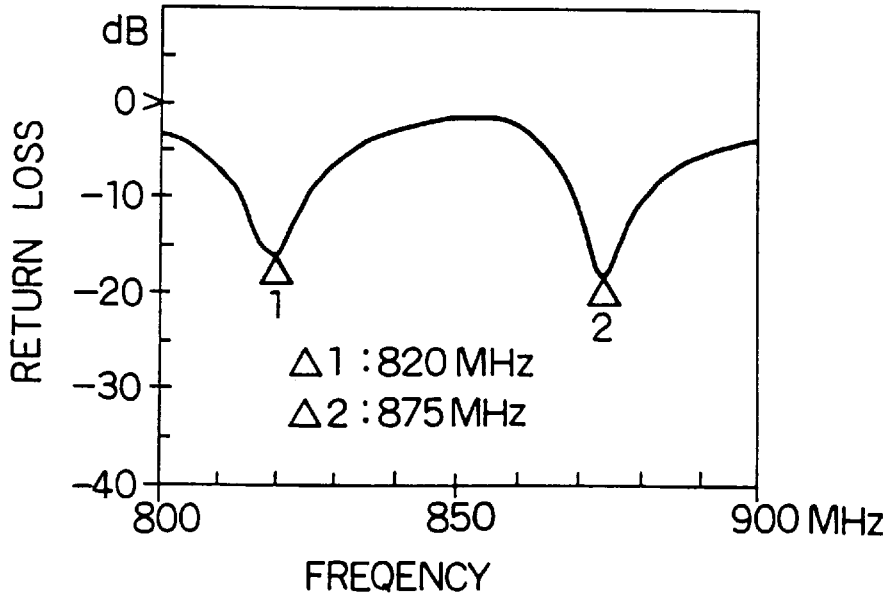
FIG. 6 is a diagram showing a return loss frequency characteristic of the antenna device of FIG. 5.

FIG. 6 shows a return loss frequency characteristic of the antenna device shown in FIG. 5. Also in this case, the measurement was carried out by mounting the antenna device in a rectangular metal case having the dimensions of 130×40×20 mm. As apparent from FIG. 6, the antenna device resonates at two points, i.e., 820 MHz and 875 MHz. In addition, the efficiency of the antenna device of the present invention was measured and high values such as −1.2 dB at 820 MHz and −0.9 dB at 875 MHz were obtained. In this way, it has been proven by an experiment that the antenna device of the present invention can resonate at desired two frequencies and can be of a small size and a high gain.

Embodiment 3

Figure 7:
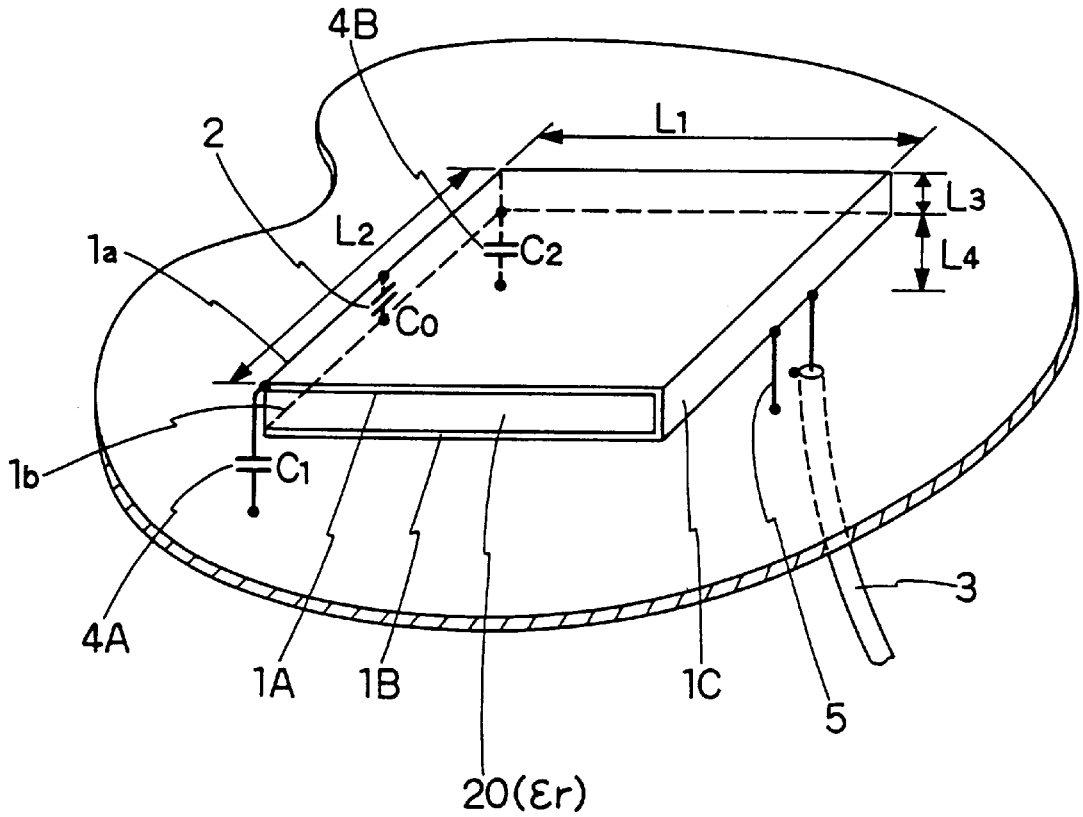
FIG. 7 is a perspective view diagram showing a third embodiment of the present invention.

FIG. 7 shows a third embodiment of the present invention wherein the right-angled quadrangular radiating patches 1A and 1B are made smaller in than the foregoing embodiments 1 and 2, and one side of one radiating patch is connected by a short-circuit metal plate 1C to the corresponding one side of the other radiating patch throughout the entire length of the side. This short-circuit metal plate 1C is connected at the center of the length direction thereof to the ground plate 6 by a grounding metal wire 5 and the coaxial feeder line 3 is connected to the short-circuit metal plate 1C. The resonance control capacitor elements 4A and 4B are connected to the mutually opposite ends of the open ended sides 1*a* and 1*b*, respectively, which are opposite the short-circuit metal 1C. The coupling control capacitor element 2 is connected between midpoints of the open ended sides 1*a* and 1*b*. By employing such a structure, an antenna device of much smaller size and much wider bandwidth can be materialized.

Figure 8:
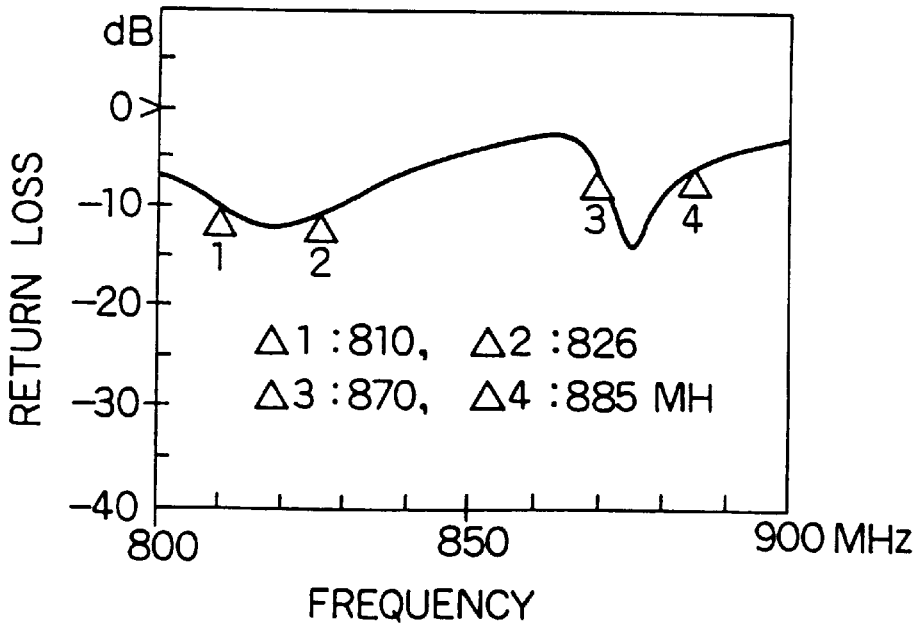
FIG. 8 is a diagram showing a return loss frequency characteristic of the antenna device of FIG. 7.

FIG. 8 shows a return loss frequency characteristic of the antenna device shown in FIG. 7. The dimensions of various portions and the capacitances of the capacitor elements of this antenna device were $L_1=L_2=25$ mm, $L_3=0.6$ mm, $L_4=5$ mm, $C_0=2$ pF, $C_1=0.45$ pF and $C_2=0.3$ pF, and the relative permittivity of the dielectric plate 20 was $\epsilon_r=2.6$. Also in this case, the antenna device was mounted in the same rectangular metal case as in the previous embodiments. As seen in the FIG. 8, the antenna device resonated at two points, i.e., at approximately 818 MHz and 875 MHz. However, in this case, each bandwidth was a little narrower. The effect in this case is the same as in the previous embodiments.

Embodiment 4

Figure 9:
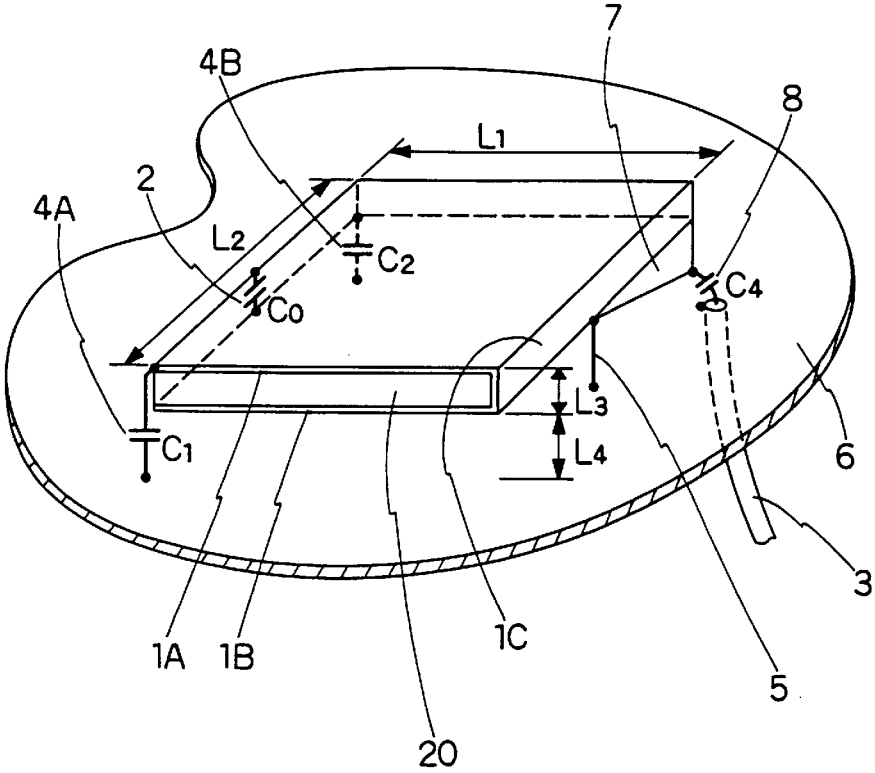
FIG. 9 is a perspective view diagram showing a fourth embodiment of the present invention.

FIG. 9 shows a fourth embodiment of the present invention wherein, a triangular metal plate 7 is connected to the lower side of the short-circuit metal plate 1C of the third embodiment of FIG. 7 such that one side of the triangular metal plate 7 extends from one end of the lower side of the short-circuit metal plate 1C to the connection point of the grounding metal wire 5. The triangular metal plate 7 is disposed perpendicularly toward the ground plate 6 such that the lower end apex faces to the ground plate 6 with a space interposed therebetween, and the coaxial feeder line 3 is connected to the lower end apex of the triangular metal plate 7 via an impedance adjusting capacitor 8. A wider bandwidth resonance characteristic can be obtained by feeding power from an apex of such a triangular metal plate 7. In this case, an antenna device of further smaller size and wider bandwidth can be achieved.

Figure 10A:
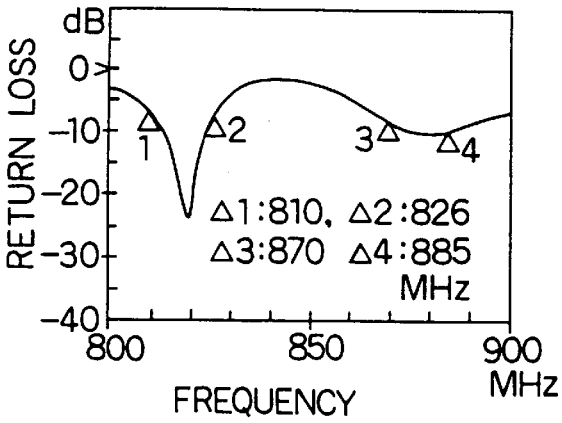
FIG. 10A is a diagram showing a return loss frequency characteristic of the antenna device of FIG. 9.
Figure 10B:
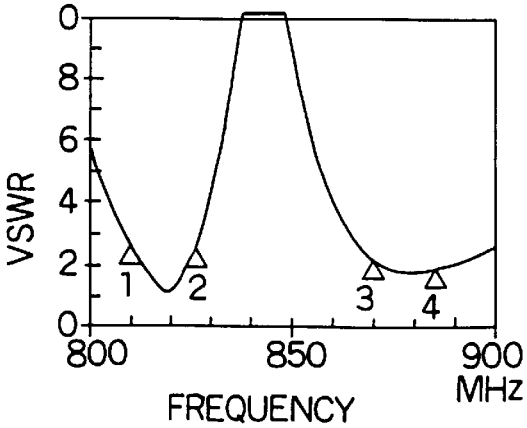
FIG. 10B is a diagram showing a VSWR frequency characteristic of the antenna device of FIG. 9.

FIG. 10A and FIG. 10B show measured results of return loss and VSWR, respectively. The dimensional parameters of the antenna are the same as those in the embodiment 3 of FIG. 7. As apparent from the figures, the antenna device resonates at two frequencies, i.e., at approximately 818 MHz and 875 MHz. Comparing to the characteristic of the embodiment 3 (FIG. 7), the resonance bandwidth around 818 MHz is narrower and the a little and resonance bandwidth around 875 MHz is considerably wider. In this case, VSWR is lest than 2.5 at each marker point.

Embodiment 5

Figure 11:
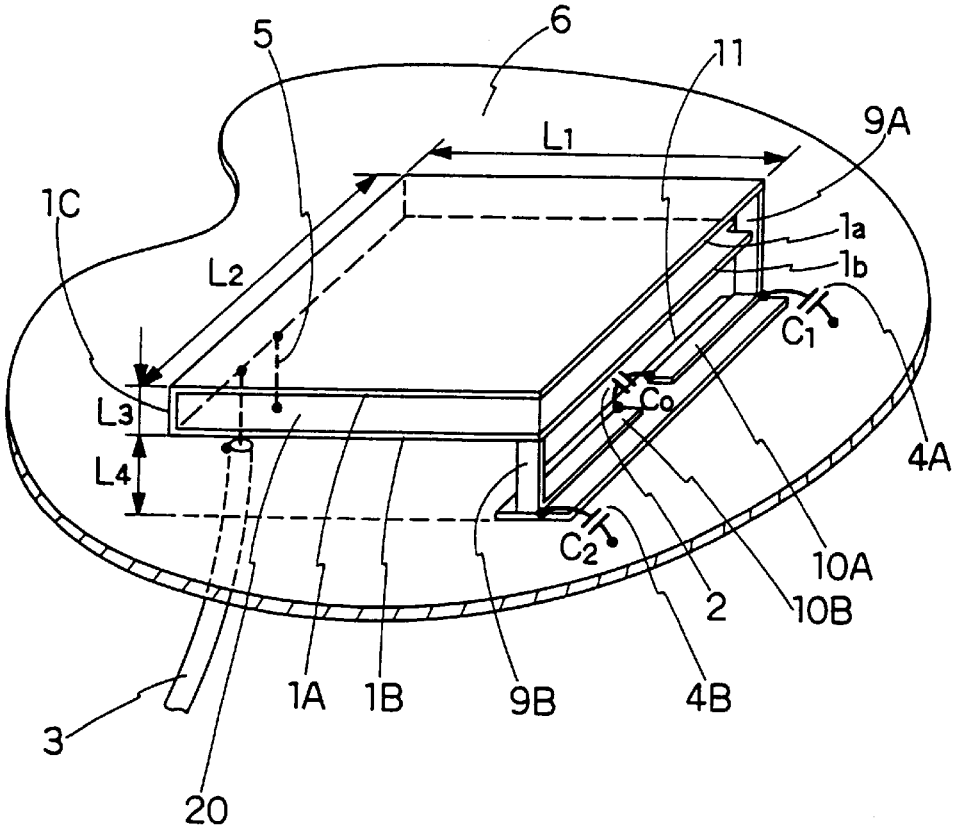
FIG. 11 is a perspective view diagram showing a fifth embodiment of the present invention.

FIG. 11 shows a fifth embodiment of the present invention wherein the capacitor elements are disposed on the ground plate 6 and these capacitor elements are connected to each of the radiating patches via metal wires respectively. Similarly to the embodiment of FIG. 7, one side of the radiating patch 1A is connected to one corresponding side of the radiating patch 1B by the short-circuit metal plate 1C throughout the entire length of the sides, and the inner conductor and the outer conductor of the coaxial feeder line 3 are connected to the short-circuit metal plate 1C and the ground plate 6, respectively. Furthermore, the short-circuit metal plate 1C is connected to the ground plate 6 by the grounding metal wire 5. In this embodiment, conductor leads 9A and 9B respectively connected to the mutually opposite ends of the open ended sides 1*a* and 1*b* of the radiating patches 1A and 1B are extended toward the ground plate 6 and are bent at right angles on a rectangular insulating spacer 11 provided on the upper surface of the ground plate 6 facing to the open ended sides 1*a* and 1*b* of the radiating patches, and are further extended toward each other on the spacer 11 to form conductor leads 10A, 10B whose end portions are opposed to each other with a space interposed therebetween. One terminal of the resonance control capacitor 4A is connected to the bending point between the conductor leads 9A and 10A and one terminal of the resonance control capacitor 4B is connected to the bending point between the conductor leads 9B and 10B. The other terminals of the resonance control capacitors 4A and 4B are connected to the ground plate 6. Both terminals of the coupling control capacitor element 2 are respectively connected to the end portions of the conductor leads 10A and 10B.

Since the capacitor elements 2, 4A and 4B can be mounted on the ground plate 6 via the spacer 11 or directly together with the other components (not shown) of a radio apparatus in the same production step by using the conductor leads 9A, 9B, 10A and 10B, the production efficiency becomes high and the use of the conductor leads is very advantageous.

Figure 12:
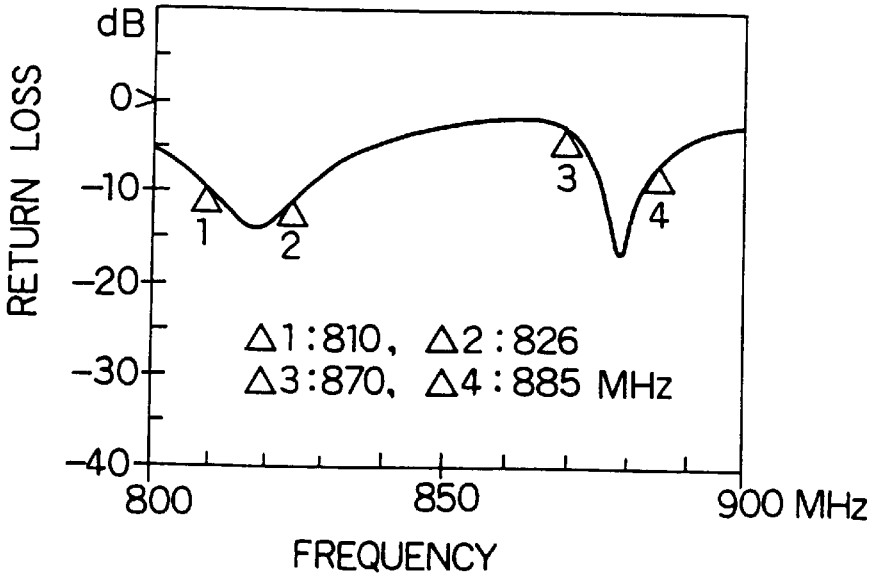
FIG. 12 is a diagram showing a return loss frequency characteristic of the antenna device of FIG. 11.

FIG. 12 shows a measurement result of the return loss of the antenna device according to the embodiment of FIG. 11. The dimensions of the various portions of the antenna device are $L_1=L_2=30$ mm, $L_3=1.6$ mm, and $L_4=5$ mm. The capacitances of the capacitor elements 2, 4A and 4B are $C_0=1.5$ pF, $C_1=0.3$ pF, and $C_2=0.8$ pF. As apparent from the figure, even if the capacitor elements are disposed on the ground plate, the measurement result exhibits two resonance characteristic similarly to the previous embodiments.

Embodiment 6

Figure 13:
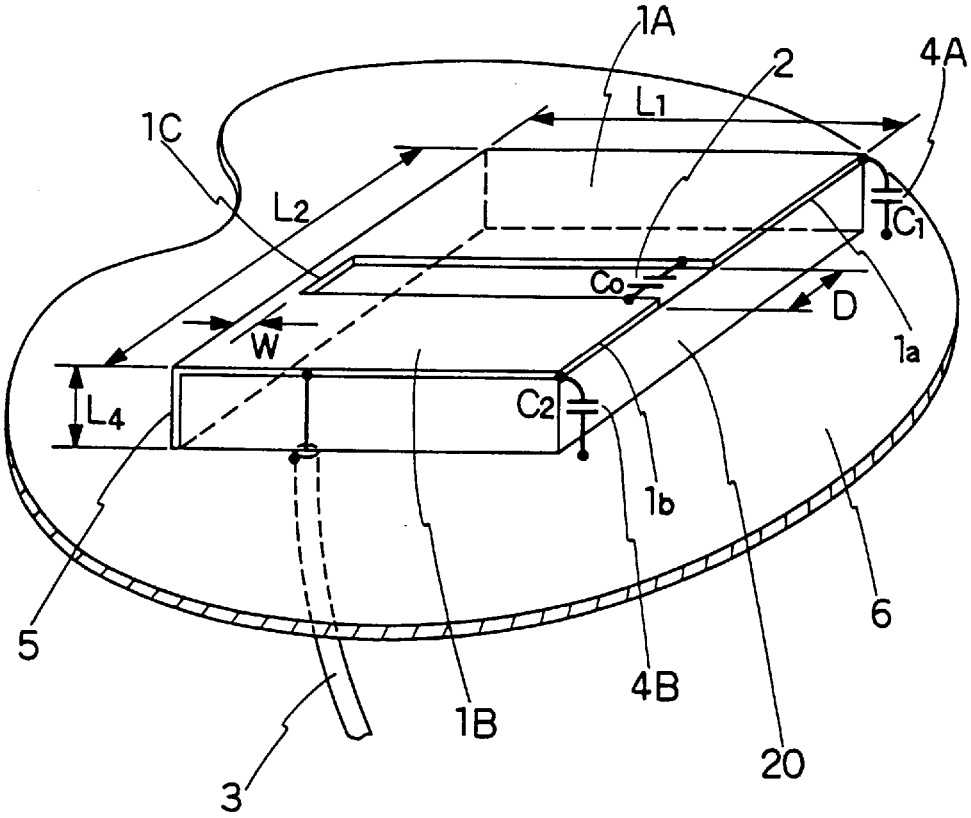
FIG. 13 is a perspective view diagram showing a sixth embodiment of the present invention.

FIG. 13 shows a sixth embodiment of the present invention. In this embodiment, two radiating patches 1A and 1B are formed on the same surface of a right-angled quadrangular dielectric plate 20 with a space D interposed therebetween. A grounding metal plate 5 is disposed to extend along the entire length of one side-wall surface of the dielectric plate 20 in the direction in which the radiating patches 1A and 1B are arranged. The upper side of the grounding metal plate 5 is connected to one side of each of the two radiating patches 1A and 1B throughout the entire length thereof. The lower side of the grounding metal plate 5 is connected to the ground plate 6. Further, a metal plate 1C of width W for interconnecting the two radiating patches 1A, 1B is disposed on the same surface of the dielectric plate 20 where the two radiating patches are formed. One side edge of the metal plate 1C is connected to the grounding plate 5. The resonance control capacitor elements 4A and 4B are connected between the end points farthest from each other on the open ended sides 1*a* and 1*b* of the radiating patches 1A, 1B and the ground plate 6 respectively. The coupling control capacitor element 2 is connected between the end points closest to each other on the open ended sides 1*a* and 1*b* of the two radiating patches 1A and 1B. The inner conductor of the coaxial feeder line 3 is connected to a side of one radiating patch (the radiating patch 1B in this case) opposite from the other radiating patch 1A. However, the inner conductor of the coaxial feeder line 3 may be connected to on the same side of one radiating patch as the other radiation patch 1A. With this arrangement, an antenna device having a wide bandwidth can be achieved in spite of its use of a flat plate.

Figure 14:
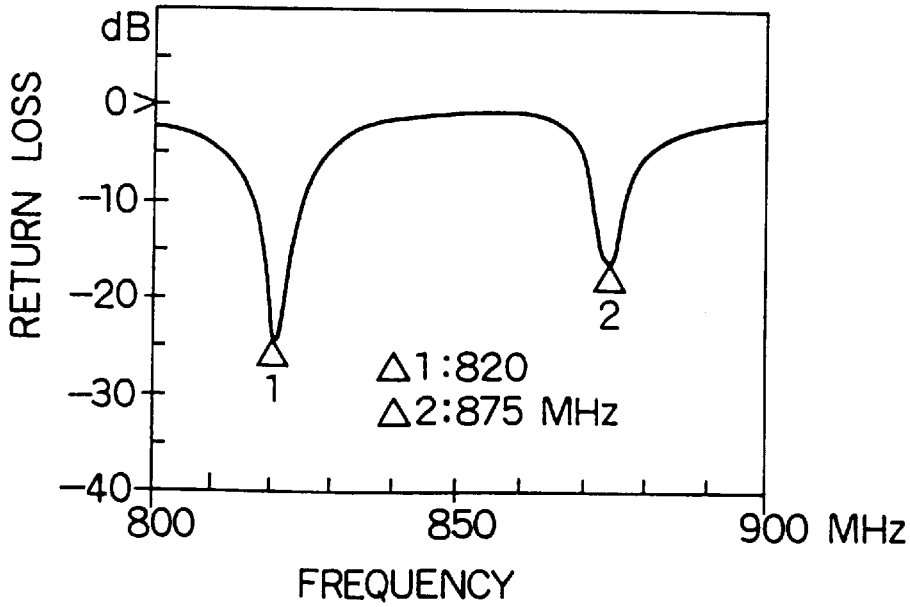
FIG. 14 is a diagram showing a return loss frequency characteristic of the antenna device of FIG. 13.

FIG. 14 shows the return loss measured on the antenna device of the embodiment of FIG. 13. The dimensions of the various portions are $L_1=L_2=30$ mm, $L_3=4.8$ mm, D=1 mm and W=3 mm. The capacitances of the capacitor elements are $C_0=2.0$ pF, $C_1=0.8$ pF and $C_2=1.1$ pF. As apparent from the figure, the antenna device resonates at 820 MHz and at 875 MHz. In this way, it is possible to resonate the antenna device at two close frequencies as in the earlier described embodiments even if the antenna device is so arranged that the two radiating patches 1A and 1B are disposed in parallel in the same plane with a space of only 1 mm interposed therebetween. As a result, a small size and high gain antenna device can be obtained.

The radiating patches 1A and 1B in the embodiments of FIGS. 3, 5, 7, 9 and 11 may be disposed in parallel on a same plane similarly to FIG. 13.

Embodiment 7

Figure 15:
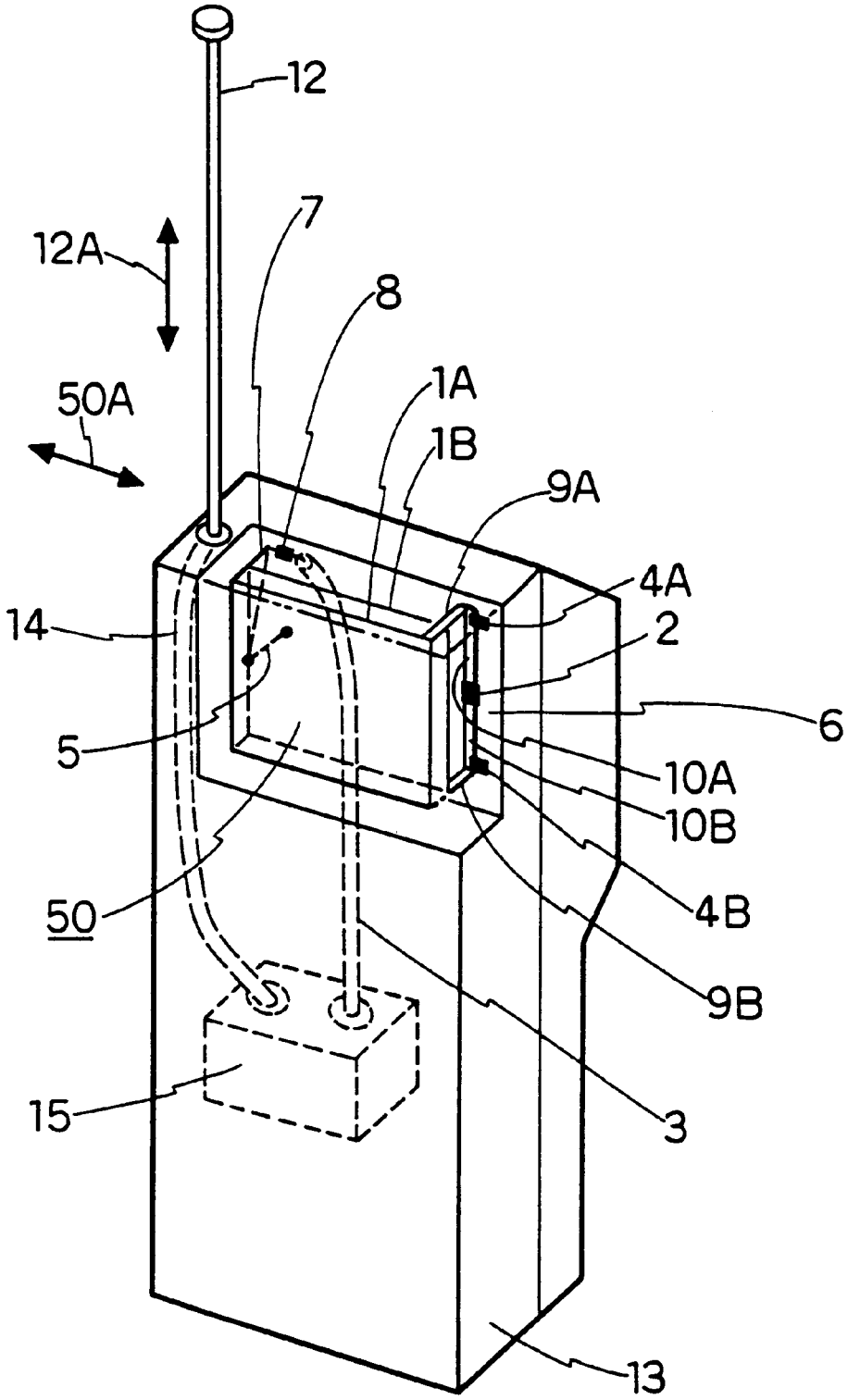
FIG. 15 is a perspective view diagram showing a seventh embodiment of the present invention.

FIG. 15 shows a mobile radio set employing an antenna of the present invention together with a whip antenna to form a diversity system. The antenna device 50 of the present invention and the whip antenna 12 are disposed such that the polarization directions 50A and 12A of radiation which provide maximum gains to the antenna device 50 and the whip antenna 12, respectively, are mutually orthogonal. In this case, the reference numerals 1–10 denote those components of the same reference numerals in the foregoing embodiments. The reference numeral 12 denotes the whip antenna, 13 is a case of the mobile radio apparatus, 14 is a feeder line of the whip antenna and 15 is an internal radio circuit. When the two antennas are disposed in such a way, coupling between the whip antenna 12 and the antenna of the present invention 50 is reduced in the radio apparatus while maintaining the wide bandwidth characteristic, and their gains are increased because the polarization directions of the whip antenna and the built-in antenna for the maximum gains are mutually orthogonal.

In this embodiment, it is also possible that the antenna device can be resonated at two arbitrary frequencies. Also, the antenna device is small in size and high in gain. A higher gain can also be obtained when the antenna device is used in combination with another antenna as in a diversity arrangement etc.

EFFECT OF THE INVENTION

As explained above, the present antenna device can be resonated at two desired frequencies by connecting the coupling control capacitor element 2 between the two radiating patches 1A and 1B, and by connecting, when necessary, the resonance control capacitor elements 4A and 4B between the radiating patches and the ground panel, respectively. Since the radiating patches can be disposed with a small space therebetween even if the antenna device is resonated at very close frequencies, the size of the antenna device does not become large, and a small size and wide bandwidth (or resonating at two frequencies) antenna device can be achieved.

We claim:

1. An antenna device having two resonance frequencies, comprising:

a ground plate;

a dielectric plate disposed in parallel with said ground plate;

at least two radiating patches disposed with a space therebetween in parallel with said ground plate on said dielectric plate, one end of each of said radiating patches being electrically grounded to said ground plate;

a single feeder line having an inner conductor and an outer conductor connected to at least one of said two radiating patches and said ground plate respectively; and a coupling control capacitor element connected between said radiating patches for cancelling the effects of electromagnetic coupling between said radiating patches;

the capacitance of said coupling control capacitor element being so selected that a current that is electromagnetically coupled from one of said two radiating patches to the other of said radiating patches and a current that is supplied from one to the other of said two radiating patches via said coupling control capacitor element are in opposite phase to each other at said other one of said radiating patches.

2. The antenna device according to claim 1, wherein said two radiating patches are disposed respectively on opposing surfaces of said dielectric plate in opposing relation to each other, and said dielectric plate is disposed in parallel with said ground plate with a space interposed therebetween.

3. The antenna device according to claim 1, wherein said two radiating patches are disposed with a space interposed therebetween on a common upper surface of said dielectric plate disposed on said ground plate.

4. The antenna device according to any one of claims 1, 2 and 3 wherein a first resonance control capacitor element is connected between at least one of said two radiating patches and said ground plate for resonance control of said one radiating patch.

5. The antenna device according to claim 4, wherein a second resonance control capacitor element is connected between the other one of said two radiating patches and said ground plate for resonance control of said other radiating patch.

6. The antenna device according to any one of claims 1, 2 and 3, wherein conductor leads connected to said two radiating patches, respectively, are extended such that end portions of the conductor leads oppose said ground plate and approach each other, and said coupling capacitor element is connected between the end portions of said conductor leads.

7. The antenna device according to claim 6, wherein said conductor leads are disposed to extend on an upper surface of an insulating spacer provided on said ground plate such that the end portions of said conductor leads approach each other, and a resonance control capacitor element is connected between at least one of said conductor leads disposed on said insulating spacer and said ground plate.

8. The antenna device according to any one of claims 1, 2 and 3, wherein each of said two radiating patches is a quadrangle having at least one side which is parallel with one side of the other radiating patch, and metal grounding means connect said one side of one radiating patch and said one side of the other radiating patch which are parallel with one another to said ground plate.

9. The antenna device according to claim 8, wherein said metal grounding means includes at least one metal panel for connecting at least one portion of each of said parallel sides of said two radiating patches to said ground panel.

10. The antenna device according to claim 8, wherein said metal grounding means includes a short-circuit metal plate for short-circuiting said parallel sides of said two radiating patches throughout their entire length, and a grounding metal wire for connecting said short-circuit metal plate to said ground plate.

11. The antenna device according to claim 8, wherein said metal grounding means includes a short-circuit metal plate for short-circuiting said parallel sides of said two radiating patches throughout their entire length, one side of said short-circuit metal plate being connected to said ground plate.

12. The antenna device according to claim 2, wherein each of said two radiating patches is a quadrangle having at least one side which is parallel with one side of the other radiating patch, said patches having other sides, respectively facing said parallel sides, which are not parallel with one another.

13. The antenna device according to claim 12, wherein said non-parallel sides are inclined against said parallel sides in mutually opposite directions and are mutually intersecting.

14. The antenna device according to claim 10, wherein the inner conductor of said feeder line is electrically connected to said short-circuit metal plate.

15. The antenna device according to claim 13, wherein the antenna includes a triangular metal plate having one side connected to said short-circuit metal plate and an apex opposite said one side disposed in the proximity of said ground plate, the inner conductor of said feeder line being electrically connected to said apex of said triangular metal plate.

16. The antenna device according to claim 15, wherein the inner conductor of said feeder line is connected to said apex of said triangular metal plate via an impedance control capacitor element.

17. The antenna device according to claim 10, wherein said coupling control capacitor element is connected between sides of said patches that respectively face said parallel sides of said two radiating patches.

18. The antenna device according to any one of claims 1, 2 and 3, wherein said antenna device is used in combination with a whip antenna so disposed that the polarization directions of said antenna device and the whip antenna are orthogonal to each other.

* * * * *